US008327952B2

(12) United States Patent
Amadei et al.

(10) Patent No.: US 8,327,952 B2
(45) Date of Patent: Dec. 11, 2012

(54) SELF-CONTAINED SYSTEM FOR DRILLING A DRAINHOLE

(75) Inventors: Christophe Amadei, Serres Castet (FR); Emmanuel Derbez, Wimereux (FR)

(73) Assignee: Total SA, Courbevoie (FR)

( * ) Notice: Subject to any disclaimer, the term of this patent is extended or adjusted under 35 U.S.C. 154(b) by 584 days.

(21) Appl. No.: 12/251,996

(22) Filed: Oct. 15, 2008

(65) Prior Publication Data

US 2009/0095533 A1 Apr. 16, 2009

(30) Foreign Application Priority Data

Oct. 16, 2007 (FR) ..... 07 07240

(51) Int. Cl.
*E21B 43/00* (2006.01)
*E21B 7/04* (2006.01)

(52) U.S. Cl. ..... 175/62; 175/81; 175/104; 166/369

(58) Field of Classification Search ..... 175/62, 175/81, 79, 104; 166/65.1, 369
See application file for complete search history.

(56) References Cited

U.S. PATENT DOCUMENTS

| | | | | |
|---|---|---|---|---|
| 2,438,637 | A * | 3/1948 | Jansen | 37/189 |
| 3,007,534 | A * | 11/1961 | Salnikov et al. | 175/104 |
| 4,365,676 | A | 12/1982 | Boyadjieff et al. | |
| 5,553,680 | A * | 9/1996 | Hathaway | 175/78 |
| 6,220,372 | B1 | 4/2001 | Cherry | |
| 6,241,029 | B1 * | 6/2001 | Coenen et al. | 175/44 |
| 7,055,625 | B1 | 6/2006 | Myrick et al. | |
| 7,093,673 | B2 * | 8/2006 | Stokka | 175/40 |
| 2002/0005286 | A1 * | 1/2002 | Mazorow et al. | 166/255.3 |
| 2002/0011357 | A1 | 1/2002 | Trueman et al. | |
| 2005/0252688 | A1 | 11/2005 | Head et al. | |

FOREIGN PATENT DOCUMENTS

| | | |
|---|---|---|
| CN | 1260857 | 7/2000 |
| FR | 1417993 | 10/1965 |
| WO | WO 98/59146 | 12/1998 |

OTHER PUBLICATIONS

"Horizontal Radial Drilling System" by W. Dickinson and R.W. Dickinson, 1985, Society of Petroleum Engineers.

* cited by examiner

*Primary Examiner* — Nicole Coy
(74) *Attorney, Agent, or Firm* — Patterson Thuente Christensen Pedersen, P.A.

(57) ABSTRACT

A self-contained system for drilling a drainhole laterally to a wellbore that includes a drill head with a tool for boring a drainhole and a self-propelled device for advancing the head into the drainhole during boring; a relay unit lowered into the wellbore, arranged to position the drill head against the side-wall of the wellbore in order to initiate the boring of the drainhole laterally to the wellbore; a cable for supplying electric power to the drill head, reeled out from the relay unit; and a mechanical system for removing cuttings from the drainhole during boring, the debris removed falling down-hole.

11 Claims, 4 Drawing Sheets

SELF-CONTAINED SYSTEM FOR DRILLING A DRAINHOLE

RELATED APPLICATION

The present application claims priority to French Application No. 07 07240 filed Oct. 16, 2007, which is incorporated herein in its entirety by reference.

FIELD OF THE INVENTION

The present invention relates to a self-contained system for drilling a drainhole laterally to a wellbore, in particular for producing oil or gas, and in particular in very low permeability gas reservoirs, also called tight gas reservoirs.

BACKGROUND

Tight gas reservoirs are natural gas reservoirs in which the matrix has a very low permeability, for example, lower than 0.5 mD (millidarcy), or even lower than 0.1 mD. In these very compact reservoirs, the recovery ratios are about 10% with the production technologies used today. The simple drilling of a well is therefore insufficient to obtain economical gas production.

In order to overcome this problem, one alternative is to increase the exchange surface between the matrix and the wellbore. At the present time, this exchange surface is usually increased using a technique called hydraulic fracturing. This technique consists in hydraulically creating a fracture that is kept open by the installation of support agents. This serves to create a larger exchange surface between the matrix and the wellbore.

However, the hydraulic fracturing technique has several drawbacks:

- it is costly to implement and requires specific equipment at the well surface;
- during implementation, it is not possible to control the fracturing direction. This is because the fractures tend to advance according to the stress field in the matrix;
- finally, the injection of pressurized fluid is liable to damage and pollute the exchange surface that is created.

Alternative techniques to hydraulic fracturing also exist, for increasing the contact surface between the wellbore and the reservoir as effectively. Techniques for drilling horizontal drains, in particular, have been used for many years (for example, "Horizontal Radial Drilling System" by W. Dickinson and R. W. Dickinson, 1985, Society of Petroleum Engineers). These techniques are applied by means of drilling rigs conventionally used in the industry, comprising a directional bit hydraulically driven by the drilling fluid.

The drawback of this type of borehole, in addition to the large scale surface equipment requirements, stems from the need to circulate a fluid to drive the bit, and this is liable to damage the drain drilled during contact with the formation.

SUMMARY

There is provided a self-contained system for drilling a drainhole laterally to a wellbore, comprising:

- a drill head comprising a tool for boring a drainhole and a self-propelled device adapted to advance the head into the drainhole during boring;
- a relay unit lowered into the wellbore, arranged to position the drill head against the sidewall of the wellbore in order to initiate the boring of the drainhole laterally to the wellbore;

- a cable for supplying electric power to the drill head, reeled out from the relay unit; and
- a mechanical system for removing cuttings from the drainhole during boring, the debris removed falling downhole.

In certain embodiments of the invention, the boring system according to the invention, by means of its self-propelled head, serves to bore a drainhole to a predefined lateral distance from the wellbore. The boring of a drainhole advantageously serves to increase the exchange surface between the gas reservoir and the wellbore.

The main direction of the horizontal drain is controlled by means of the self-propelled device of the drill head, and advantageously this direction is independent of the stress field in the matrix. It is thereby possible to orient this exchange surface optimally according to the distribution of the gas reserves in the matrix.

Furthermore, the use of a system according to certain embodiments of the invention incurs no risk of damaging or polluting the exchange surface created during the boring of a drainhole. In fact, certain embodiments of the invention do not absolutely require the injection of a pressurized fluid that is liable to cause damage and/or pollution of the exchange surface.

Moreover, the system according to the invention only requires lightweight surface equipment, as opposed to other devices such as the one described in U.S. Pat. No. 6,220,372. In certain embodiments, a truck equipped with a winch and a power generator suffices to use the inventive device.

The system according to an embodiment of the invention comprises one or more of the following features:

- the system for removing cuttings comprises the electric power supply cable rotated about itself inside the drainhole;
- the electric power supply cable comprises a relief molded or fixed onto its surface;
- the electric power supply cable has a substantially helicoidal relief;
- the drill head comprises a motor for rotating the power cable;
- the relay unit also comprises a motor for rotating a portion of the relay unit storing the power cable;
- the drill head has a cross section with a diameter less than 10 centimeters.

Another aspect of the invention relates to a method for producing oil or gas, in which a wellbore is drilled up to an oil or gas reservoir present in the subsoil, the method comprising the following steps:

- lowering a relay unit into the wellbore;
- boring at least one drainhole laterally to the wellbore with a drill head powered electrically via a power cable reeled out from the relay unit, the drill head comprising a tool for boring the drainhole and a self-propelled device adapted to advance the head into the drainhole during boring;
- removing the cuttings from the drainhole during the boring by a mechanical system, the debris removed falling downhole; and
- recovering the oil or gas from the reservoir via the drainhole and the wellbore.

The method according to an embodiment of the invention comprises one or more of the following features:

- a helicoidal relief is formed on the power cable, and the power cable is rotated about itself inside the drainhole to remove the cuttings;
- the drainhole has a diameter less than 10 centimeters;
- the oil or gas reservoir is present in a zone of the subsoil having a permeability less than 0.1 millidarcy.

DETAILED DESCRIPTION OF THE INVENTION

For reasons of clarity, the various parts shown in the figures are not necessarily to scale.

Figure 1:
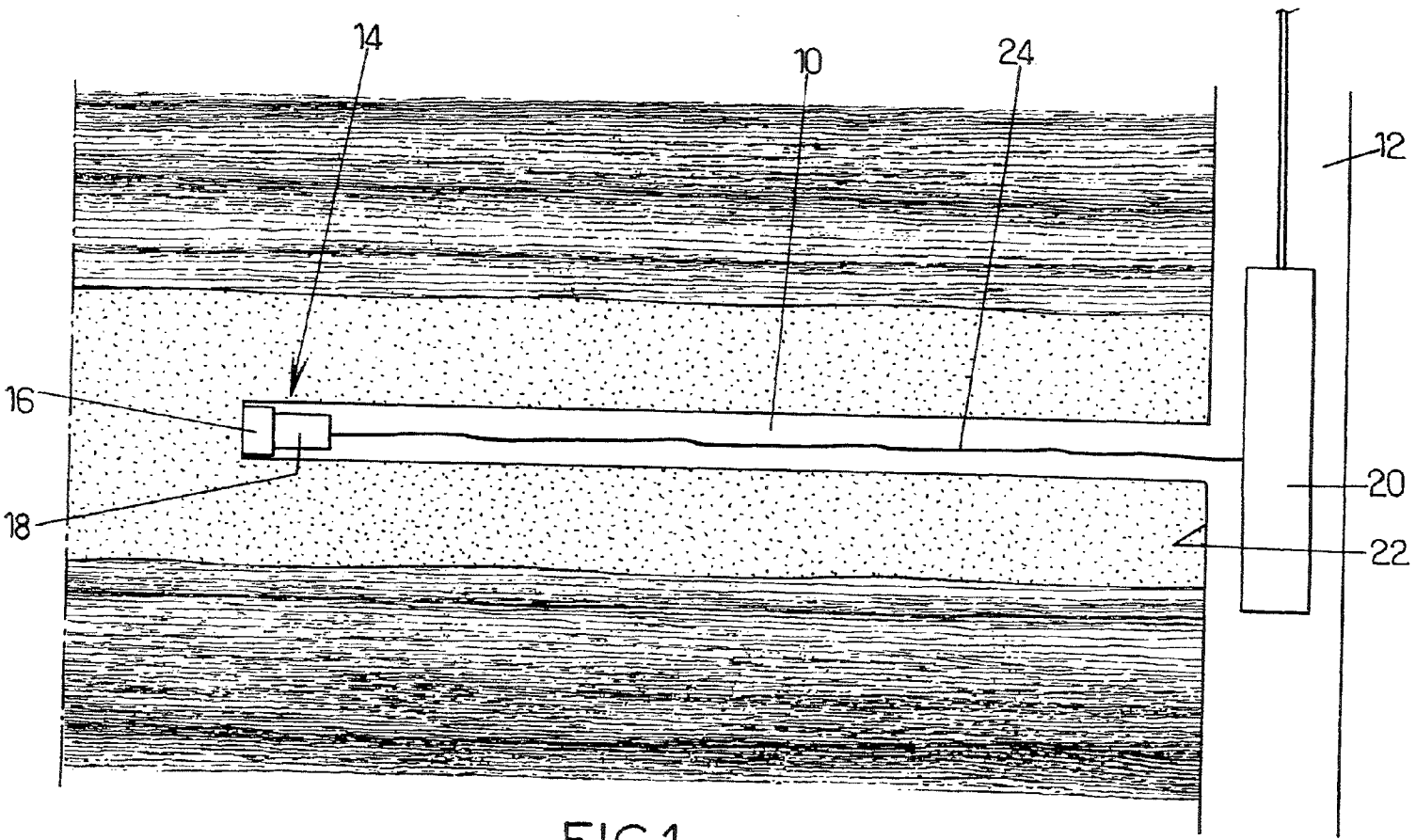
FIG. 1 is a schematic view of the system according to an embodiment of the invention.

FIG. 1 shows a self-contained system for drilling a drainhole 10 laterally to a wellbore 12 in a tight gas reservoir, according to a first embodiment of the invention.

Typically, the wellbore has a diameter of about 10 to 50 centimeters and a depth of up to several hundreds or thousands of meters. The drainhole 10 bored by the system according to the invention has a diameter less than 10 cm, and in some embodiments less than 5 cm, along a length of about 200 m.

In this first embodiment, the self-contained drilling system according to the invention comprises a drill head 14 comprising a tool 16 for boring a drainhole 10 and a self-propelled device 18 adapted to advance the drill head 14 into the drainhole 10 during drilling. The system according to the invention further comprises a relay unit 20 lowered into the wellbore 12, arranged to position the drill head 14 against the sidewall 22 of the wellbore 12 in order to initiate the drilling of the drainhole 10 laterally to the wellbore 12. The system according to the invention is also provided with a cable 24 for supplying electric power to the drill head 14, reeled out from the relay unit 20 and a mechanical system for removing cuttings from the drainhole 10 during boring, the debris removed falling down wellbore 12.

Drill bits comprising self-propelled heads 14 are known to a person skilled in the art and are described for example in U.S. Pat. No. 7,055,625.

The self-propelled device 18 serves to advance the drill head into the drainhole 10 and to keep the said drill head 14 in place during the drilling of the said drain hole 10 by the boring tool 16. Various propulsion devices known to a person skilled in the art can be used.

Figure 2:
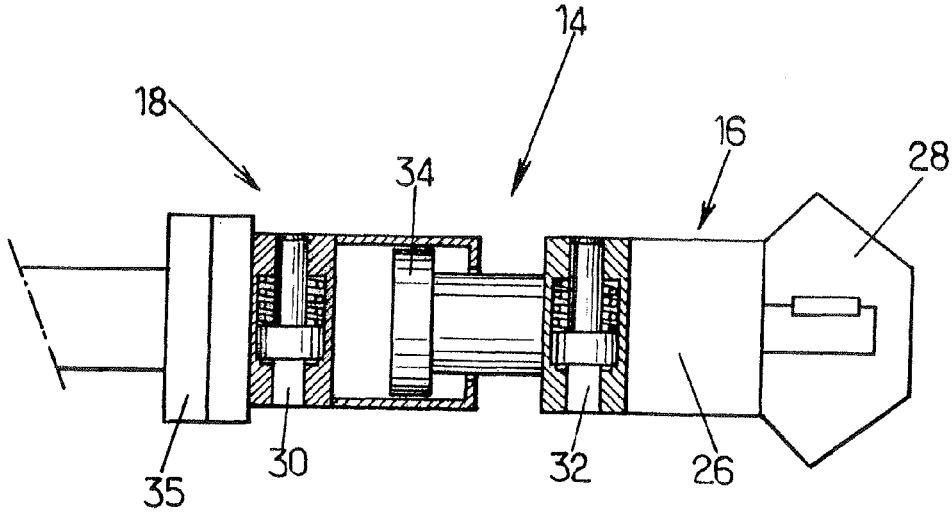
FIG. 2 is a schematic view of a drill head of a self-contained drilling system according to an embodiment of the invention.

In the embodiment shown in FIG. 2, the boring tool 16 may, for example, comprise an electric motor 26 rotating a bit 28 for drilling a drainhole 10, for example having a diameter of about 7 cm.

According to the embodiment shown in FIG. 2, the self-propelled device 18 may, for example, comprise a rear anchor jack 30 and a front anchor jack 32. The said self-propelled device 18 further comprises an axial piston 34. The operating principle of the drilling system according to this embodiment comprises the following five successive steps:

- a rear anchoring step during which the rear anchor jack 30 applies a pressure to the surface of the drainhole in a direction perpendicular to the axis of the drill head 14;
- a drilling step during which the boring tool 16 drills a portion of the drainhole 10 under the effect of an axial thrust applied by the axial piston 34;
- a front anchoring step during which the front anchor jack 32 applies a pressure to the surface of the drainhole in a direction perpendicular to the axial direction and during which the rear anchor jack 30 is retracted;
- an advanced step during which the axial piston 34 is contracted; and
- a rear anchoring step during which the rear anchor jack 30 is anchored to the surface of the drainhole 10 and the front anchor jack 32 is released from the said drainhole surface. The penetration cycle of the self-propelled device is repeated as many times as necessary.

The drill head 14 is powered via an electric power supply cable 24 reeled out from the relay unit 20. The said power cable is rotated by a rotary motor 35.

Figure 3:
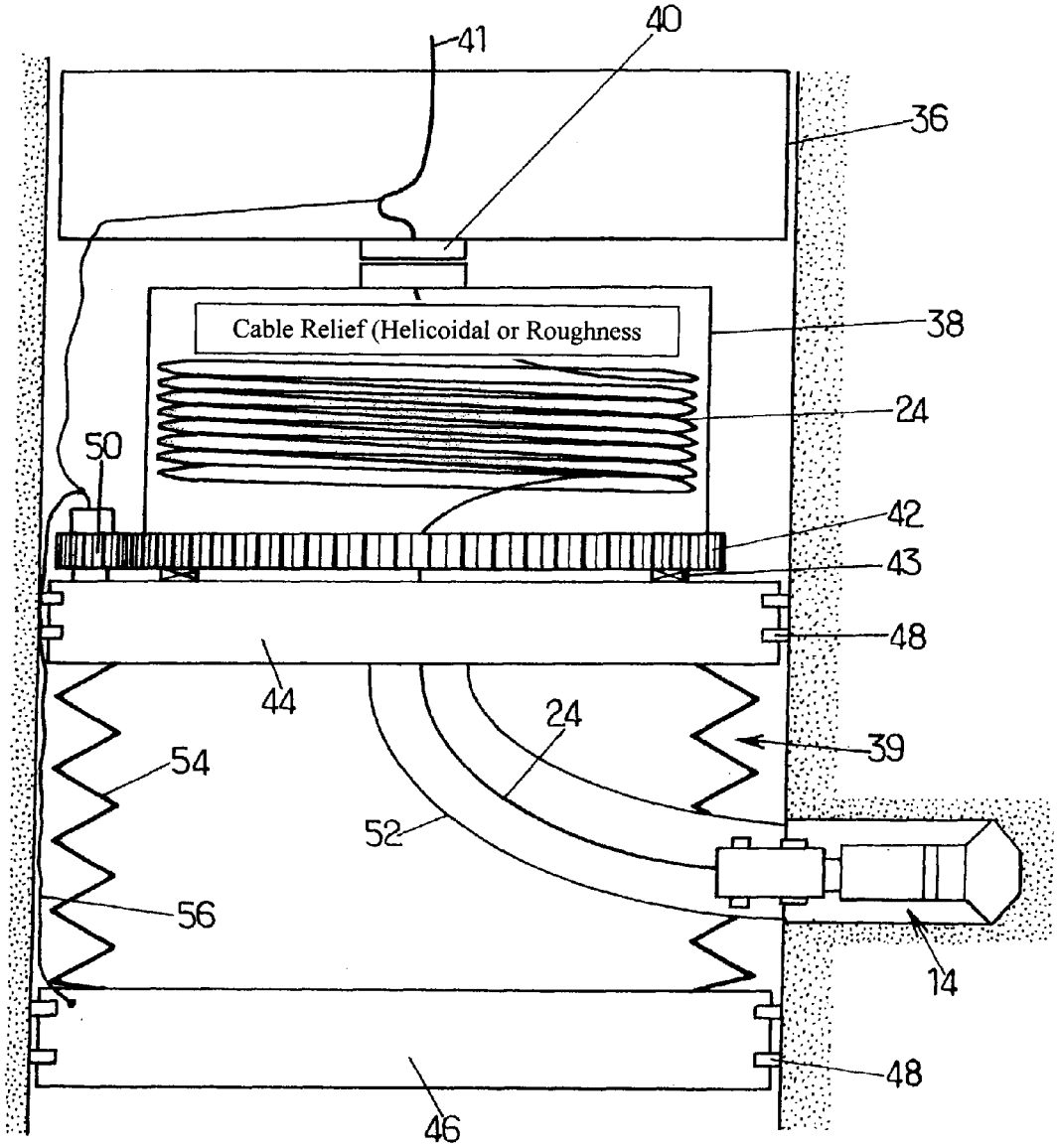
FIG. 3 is a schematic view of a system according to an embodiment of the invention.
Figure 8:
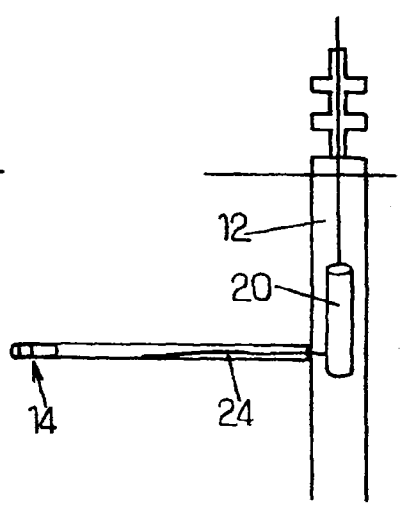
FIGS. 4 to 8 are schematic views of various steps of a method for producing natural gas according to an embodiment of the invention.
Figure 7:
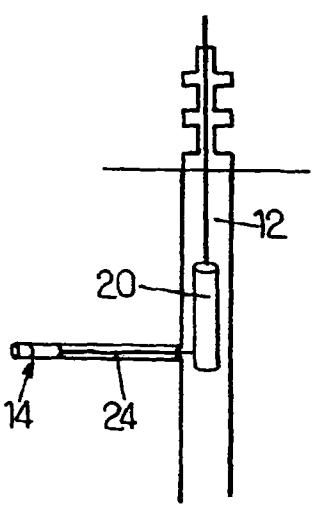
Figure 6:
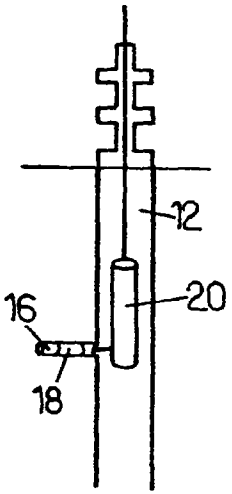
Figure 5:
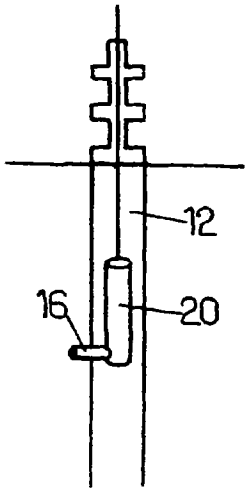
Figure 4:
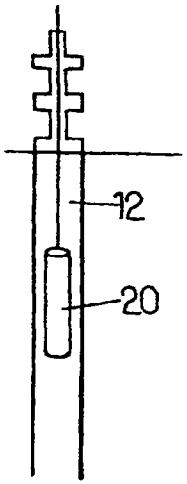

In the embodiment shown in FIG. 3, the relay unit 20 comprises an anchoring unit 36, a cable storage unit 38 and a positioning unit 39.

The anchoring unit 36 is, for example, anchored by means of anchor jacks (not shown) capable of applying a pressure to the sidewalls of the wellbore 12 in a direction perpendicular to the main axis of the wellbore.

According to this embodiment, the anchoring unit 36 distributes electric power to the other units of the relay unit 20. The electric power may be supplied by a general electrical cable 41 electrically connecting the anchoring unit 36 to the surface.

In this embodiment, the anchoring unit 36 transmits the electric power to the cable storage unit 38 via a rotating commutator 40. The rotating commutator 40 serves to transmit the electric power between the two units despite the rotary movement of the cable storage unit 38.

Furthermore, the various elements of the positioning unit are supplied with electricity, for example, by means of simple electrical cables.

The cable storage unit 38 serves to store the electric power supply cable 24 of the drill head 14. In the embodiment shown in FIG. 3, the power cable is reeled in. The electric power cable 24 may comprise a relief on its surface, for example, a helicoidal relief or a simple roughness.

The cable storage unit 38 is connected to the positioning unit 39 via a rotating support 42. In the embodiment shown in FIG. 3, the rotating support 42 rests on ball bearing 43 and comprises a cable-locking device (not shown).

The cable-locking device serves to control the unreeling of the electric power supply cable 24 from the cable storage unit 38.

In the embodiment shown in FIG. 3, the positioning unit 39 comprises a first 44 and a second 46 anchor plate and a guide tube 52. The first and second anchor plates 44, 46 are arranged substantially perpendicular to the main axis of the wellbore 12.

These plates 44, 46 are anchored, for example, by means of anchor jacks 48 which apply a pressure to the sidewalls of the wellbore 12 in a direction perpendicular to the main axis of the wellbore.

The first anchor plate 44 supports the ball bearing 42 on which the cable storage unit 38 rests. The first anchor plate 44 also supports an electric motor 50 rotating the cable storage unit 38.

The electric power supply cable passes through the center of the first anchor plate 44.

The second anchor plate 46 is connected mechanically to the first anchor plate 44 by means of elastic mechanical connecting elements 54, for example, springs. The second anchor plate 46 is also connected electrically to the first anchor plate 44, for example, by means of mechanical linkage elements or even by a flexible electrical cable 56.

The second anchor plate 46 is shaped so as to enable the cuttings formed during the drilling to fall to the bottom of the wellbore 12. For example, the second anchor plate 46 comprises a set of holes allowing the passage of the cuttings.

In this embodiment, the positioning unit 39 comprises a guide tube 52 between the first 44 and the second 46 anchor plates.

The guide tube 52 is a hollow bent tube having a diameter substantially equal to the diameter of the bit 28 of the self-propelled head 14. The said tube 52 is shaped so as to allow the removal of the cuttings formed during the drilling; for example, it comprises a set of holes at its surface allowing the passage of the cuttings.

During the installation of the self-contained drilling system according to the embodiment in FIG. 3, the drill head 14 is placed in the guide tube 52 and the electric power supply cable is connected to the drill head 14.

FIGS. 4 to 8 shows various steps of a method for producing oil or gas according to the invention. According to this method, a substantially vertical well is drilled to a reservoir present in the subsoil.

During a first step, the relay unit 20 is lowered to a desired depth in the wellbore 12.

The second anchor plate 46 is then anchored in position against the sidewalls of the wellbore 12, by means of the anchor jacks 48.

The springs 54 are then compressed, for example by the weight of the relay unit 20, until the guide tube 52 stops against the sidewall of the wellbore 12.

The first anchor plate 44 is then anchored in position by means of the anchor jacks 48.

The boring tool 16 is then installed in the guide tube 52, in order to be positioned against the sidewall of the wellbore 12.

The self-propelled device 18 is then anchored to the inside surface of the guide tube 52 and fitted into the boring tool 16 thereby forming a drill head 14. The said drill head 14 is supplied with electricity by a power cable reeled out from the relay unit, in particular from the cable storage unit.

The self-propelled device then bears against the inside of the guide tube 52 to initiate the drilling of the drainhole by the boring tool 16.

In this particular embodiment, the electric power supply cable 24 comprises a helicoidal relief.

The cuttings are removed by rotating the electric power supply cable 24 by means of the electric motor 35 installed behind the self-propelled device 18.

Cuttings are then driven out of the drainhole by the rotation of the electric power supply cable 24 and fall to the bottom of the wellbore 12.

The cable storage unit 38 rotates about its main access, substantially parallel to the axis of the wellbore 12, to prevent the electric power supply cable 24 from twisting during its rotation. Preferably, the cable storage unit 38 rotates at the same speed and/or in the same direction as the electric motor 35 rotating the electric power supply cable 24.

The electric power supply cable 24 is reeled out from the cable storage unit 38 by the rotation of the said cable storage unit and by the release of the cable locking device (not shown) during the advance of the drill head 14 in the drainhole 10.

Advantageously, the relief on the surface of the electric power supply cable increases the friction between the cuttings and the rotating cable, thereby removing the cuttings more effectively.

Advantageously, a natural pressure difference between the gas contained in the tight gas reservoir and the wellbore 12 causes gas to flow into the drainhole 10, towards the wellbore 12, thereby facilitating the removal of the cuttings.

When the entire electric power supply cable 24 has been reeled out from the cable storage unit 38, the said electric power supply cable 24 can be rewound inside the cable storage unit and the relay unit can be raised to the surface. The drill head 14 can be pulled by the cable towards the wellbore, or disconnected from the electric power supply cable 24 at the level of the self-propelled device 18, and abandoned at the bottom of the drainhole, or brought back to the surface by any other means known to a person skilled in the art.

It should be observed that many alternatives can be provided for the structure and the method described above.

The invention is not limited to these typical embodiments and must be interpreted in a non-limiting manner, encompassing any equivalent embodiment.

The invention claimed is:

1. A self-contained system for drilling a drainhole laterally to a wellbore, comprising:

a drill head comprising a tool for boring a drainhole and a self-propelled device adapted to advance the drill head into the drainhole during boring;

a relay unit lowered into the wellbore, arranged to position the drill head against a sidewall of the wellbore in order to initiate boring of the drainhole laterally to the wellbore;

a cable for supplying electric power to the drill head, reeled out from a cable storage unit of the relay unit; and a mechanical system configured to remove cuttings from the drainhole and into the wellbore during boring.

2. The system according to claim 1, wherein the mechanical system for removing cuttings comprises the cable for supplying electric power rotated about itself inside the drainhole.

3. The system according to claim 2, wherein the cable for supplying electric power comprises a relief molded or fixed to its surface.

4. The system according to claim 3, wherein the cable for supplying electric power has a substantially helicoidal relief.

5. The system according to claim 1, wherein the drill head comprises a motor for rotating the cable for supplying electric power.

6. The system according to claim 1, wherein the relay unit also comprises a motor for rotating a portion of the relay unit storing the cable for supplying electric power.

7. The system according to claim 1, wherein the drill head has a cross section with a diameter less than 10 centimeters.

8. A method for producing oil or gas, wherein a wellbore is drilled up to an oil or gas reservoir present in the subsoil, the method comprising the following steps:

lowering a relay unit into the wellbore;

boring at least one drainhole laterally to the wellbore with a drill head powered electrically via a power cable reeled out from a cable storage unit of the relay unit, the drill head comprising a tool for boring the drainhole and a self-propelled device adapted to advance the head into the drainhole during boring;

removing the cuttings from the drainhole during the boring by a mechanical system, causing the removed cuttings to fall into the wellbore; and recovering the oil or gas from the reservoir via the drainhole and the wellbore.

9. The method according to claim 8, wherein a helicoidal relief is formed on the power cable, and the power cable is rotated about itself inside the drainhole to remove the cuttings.

10. The method according to claim 8, wherein the drainhole has a diameter less than 10 centimeters.

11. The method according to claim 8, wherein the oil or gas reservoir present in a zone of the subsoil has a permeability less than 0.1 millidarcy.

* * * * *